US006841223B2

(12) United States Patent
Rice et al.

(10) Patent No.: US 6,841,223 B2
(45) Date of Patent: Jan. 11, 2005

(54) COMPOSITE PAVEMENT MARKINGS

(75) Inventors: Eric E. Rice, Woodbury, MN (US); Thomas P. Heblom, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 71 days.

(21) Appl. No.: 09/929,417

(22) Filed: Aug. 14, 2001

(65) Prior Publication Data

US 2003/0035927 A1 Feb. 20, 2003

(51) Int. Cl.[7] ..... D06N 7/04; B32B 3/00; E01F 11/00

(52) U.S. Cl. ..... 428/143; 428/150; 428/161; 428/172; 428/195; 428/323; 428/325; 428/331; 404/11; 404/14; 404/15; 404/16

(58) Field of Search ..... 428/143, 150, 428/161, 172, 195, 323, 325, 331; 404/11, 14–16

(56) References Cited

U.S. PATENT DOCUMENTS

| | | | | |
|---|---|---|---|---|
| 3,399,607 A | | 9/1968 | Eigenmann | |
| 3,709,706 A | | 1/1973 | Sowman | 106/57 |
| 3,785,719 A | * | 1/1974 | Jonnes | 359/538 |
| 3,877,786 A | | 4/1975 | Booras et al. | 350/105 |
| 4,040,760 A | | 8/1977 | Wyckoff | 404/14 |
| 4,117,192 A | | 9/1978 | Jorgensen | 428/337 |
| 4,129,673 A | * | 12/1978 | Eigenmann | 428/172 |
| 4,166,147 A | | 8/1979 | Lange et al. | 428/328 |
| 4,388,359 A | | 6/1983 | Ethen et al. | 428/143 |
| 4,490,432 A | | 12/1984 | Jordan | 428/220 |
| 4,564,556 A | | 1/1986 | Lange | 428/325 |
| 4,681,401 A | | 7/1987 | Wyckoff | 350/105 |
| 4,714,656 A | | 12/1987 | Bradshaw et al. | 428/411.1 |
| 4,758,469 A | | 7/1988 | Lange | 428/325 |
| 4,772,511 A | | 9/1988 | Wood et al. | 428/325 |

(List continued on next page.)

FOREIGN PATENT DOCUMENTS

| | | | |
|---|---|---|---|
| EP | 0 101 084 A2 | 2/1984 | |
| EP | 0 237 315 A2 | 9/1987 | |
| EP | 0 683 270 A2 A3 | 11/1995 | E01F/9/04 |
| EP | 0 683 270 B1 | 7/2001 | E01F/9/04 |
| WO | WO 97/01677 | 1/1997 | |
| WO | WO 99/25928 | 5/1999 | |

*Primary Examiner*—Harold Pyon
*Assistant Examiner*—Patricia L. Nordmeyer

(57) ABSTRACT

Composite pavement markings with improved wear resistance and other advantages are disclosed. The composite pavement markings typically include a unitary retroreflective article attached to a base pavement marking. With the composite construction, different portions of the pavement marking are provided at different heights. The taller portions of the pavement marking may preferably offer some protection to the shorter portions from wear caused by vehicle traffic and/or snowplow blades. By combining two different retroreflective pavement markings to form the composite pavement markings of the present invention, a combination of features and properties may be obtained that is provided by neither of the pavement markings alone. Methods of manufacturing composite pavement markings are also disclosed.

24 Claims, 4 Drawing Sheets

U.S. PATENT DOCUMENTS

| | | | | |
|---|---|---|---|---|
| 4,875,798 | A | 10/1989 | May | 404/12 |
| 4,937,127 | A | 6/1990 | Haenggi et al. | 428/148 |
| 4,969,713 | A | 11/1990 | Wyckoff | 350/109 |
| 4,988,541 | A | 1/1991 | Hedblom | 427/163 |
| 4,988,555 | A | 1/1991 | Hedblom | 428/172 |
| 5,053,253 | A | 10/1991 | Haenggi et al. | 427/204 |
| 5,087,148 | A | 2/1992 | Wyckoff | 404/12 |
| 5,087,221 | A | 2/1992 | Linton et al. | 452/5 |
| 5,094,902 | A | 3/1992 | Haenggi et al. | 428/150 |
| 5,108,218 | A | 4/1992 | Wyckoff | 404/14 |
| 5,114,193 | A | 5/1992 | Nass | 292/67 |
| 5,124,178 | A | 6/1992 | Haenggi et al. | 427/204 |
| 5,139,590 | A | 8/1992 | Wyckoff | 156/71 |
| 5,227,221 | A | 7/1993 | Hedblom | 428/172 |
| 5,286,682 | A | 2/1994 | Jacobs et al. | 501/34 |
| 5,316,406 | A | 5/1994 | Wyckoff | 404/12 |
| 5,536,569 | A | 7/1996 | Lasch et al. | 428/328 |
| 5,557,461 | A | 9/1996 | Wyckoff | 359/551 |
| 5,593,246 | A | 1/1997 | Hedblom et al. | 404/9 |
| 5,643,655 | A | 7/1997 | Passarino | 428/143 |
| 5,670,227 | A | 9/1997 | Hedblom et al. | 428/48 |
| 5,676,488 | A | 10/1997 | Hedblom | 404/9 |
| 5,777,791 | A | 7/1998 | Hedblom | 359/536 |
| 5,880,885 | A | 3/1999 | Bailey et al. | 359/529 |
| 5,928,761 | A | 7/1999 | Hedblom et al. | 428/143 |

* cited by examiner

COMPOSITE PAVEMENT MARKINGS

FIELD OF THE INVENTION

The present invention relates to the field of pavement markings. More particularly, the present invention provides composite pavement markings and methods of manufacturing the same.

BACKGROUND OF THE INVENTION

Pavement markings are used on roadways to display traffic lanes and other traffic information to motor vehicle drivers. Very often pavement markings are retroreflective so that motor vehicle drivers can see the markings at nighttime. Retroreflective pavement markings have the ability to return a substantial portion of incident light towards the source from which the light originated. Light from motor vehicle headlamps is returned toward the oncoming vehicle to illuminate, e.g., the boundaries of the traffic lanes for the motor vehicle driver.

Known retroreflective pavement markings typically include a rubber base sheet that contains pigments and fillers. Optical elements and/or skid-resistant particles are typically secured to a base sheet by being embedded therein or are secured thereto by a bonding material or binder. Pigments and fillers typically are dispersed throughout the base sheet for a number of reasons, including reducing cost, improving durability, and providing conformability. Pigments have also been placed in the bonding material to enhance visibility of the pavement marking and as part of the retroreflective mechanism.

When the pavement marking is retroreflective, it may include a raised pattern of protrusions on the upper surface of the base sheet to provide a more effective orientation for retroreflection and/or to elevate the optical elements above any water or other liquids on the roadway, thereby enhancing reflectivity of the pavement marking under wet conditions; see, for example, U.S. Pat. Nos. 5,227,221; 5,087,221; 5,087,148; 4,988,555; 4,988,541; 4,969,713; and 4,388,359.

As the spacing between the raised patterns of protrusions has been increased to improve retroreflectivity by reducing shadowing effects (see, e.g., U.S. Pat. No. 5,670,227), the susceptibility of the pavement marking to snowplow damage has increased. The damage is thought to be caused by the digging action of the snowplow blade as it falls into the valley areas between protrusions and then strikes the sides of the protrusions.

One approach to improving the resistance of pavement markings to snowplow blades is described in International Publication No. WO 99/25928 (Hedblom et al.) in which elongated and overlapping protrusions are provided to reduce the digging action of snowplow blades.

In addition to, or in place of, changes in the shape and/or patterns of protrusions to improve resistance to snowplows, some pavement markings are also applied in grooves that are formed in the road surface. Typically, a groove about 1.2 millimeters (mm) to about 2.5 mm deep is mechanically formed in the road surface using, e.g., grinding equipment. The pavement marking is then applied within the groove. The ground surface within the groove provides an excellent surface for adhesion of the pavement marking and the depth of the groove provides some protection for the optics on the pavement marking.

There are, however, some disadvantages to this application method, including the cost of forming the grooves in the road surface. The grooves may also provide a point at which the effects of, e.g., the freeze/thaw cycle, may be enhanced, thereby degrading the road surface around and within the groove. In addition, the groove depth may be difficult to control in, e.g., asphalt surfaces. A further disadvantage may be found in the delay between formation of the grooves and application of a marking within the groove.

Furthermore, the groove may collect water which can defeat the purpose of providing raised protrusions to raise the optics above the water to enhance wet retroreflectivity of the pavement marking.

SUMMARY OF THE INVENTION

The present invention provides composite pavement markings with improved wear resistance and other advantages. The composite pavement marking includes a unitary retroreflective article attached to a base pavement marking. With the composite construction, different portions of the pavement marking are provided at different heights. The taller portions of the pavement marking may preferably offer some protection to the shorter portions from wear caused by vehicle traffic and/or snowplow blades.

The composite nature of the pavement markings of the present invention results from the combination of two independent retroreflective articles. The unitary retroreflective articles are, themselves, preferably retroreflective pavement markings attached to a base retroreflective pavement marking that includes a first portion adapted to receive the unitary retroreflective article. By combining two different retroreflective pavement markings to form the composite pavement markings of the present invention, a combination of features and properties may be obtained that is provided by neither of the pavement markings alone.

It may be preferred, e.g., that the unitary retroreflective articles attached to the composite pavement marking provide improved wet retroreflectivity to further enhance visibility of the pavement marking under both dry and wet conditions. By locating the unitary retroreflective article within those portions of the pavement marking having a reduced height, the wet reflectivity of the pavement marking may be increased by trapping or pooling water over the unitary retroreflective article. It may also be preferred that the base pavement marking provide improved dry retroreflectivity and/or improved conspicuity in daylight (where retroreflectivity is not as important).

Additional advantages of the invention may include the ability to provide pavement markings with contrasting colors to further improve conspicuity. Those colors may remain largely static or they may change over time to improve visibility of the pavement marking as the surrounding pavement changes color over time.

In one aspect, the present invention provides a composite pavement marking having a marking length and a marking width transverse to the marking length, the marking width defined by marking sides extending along the marking length, wherein the pavement marking further includes a bottom extending along the marking length and marking width. The composite pavement marking includes a first portion having a first portion width between first portion sides that is less than the marking width; a unitary retroreflective article attached to the first portion of the pavement marking, wherein a first portion height is defined by the distance between a top surface of the unitary retroreflective article and the bottom of the pavement marking; and a second portion surrounding the first portion on at least two opposing sides, wherein the second portion has a second portion height above the bottom of the pavement marking that is different than the first portion height.

In another aspect, the present invention provides a composite pavement marking having a marking length and a marking width transverse to the marking length, the marking width defined by marking sides extending along the marking length, wherein the pavement marking further includes a bottom extending along the marking length and marking width. The composite pavement marking further includes a first portion having a first portion width between first portion sides that is less than the marking width, the first portion extending along substantially all of the marking length; a unitary retroreflective article adhesively attached to the first portion of the pavement marking, wherein a first portion height is defined by the distance between a top surface of the unitary retroreflective article and the bottom of the pavement marking, and further wherein the unitary retroreflective article extends along substantially all of the marking length; and a second portion surrounding the first portion on two opposing sides, wherein the second portion has a second portion height above the bottom of the pavement marking that is greater than the first portion height.

In another aspect, the present invention provides a method of manufacturing a composite pavement marking having a marking length and a marking width transverse to the marking length, the marking width defined by marking sides extending along the marking length, wherein the pavement marking further includes a bottom extending along the marking length and marking width. The method includes providing a retroreflective base pavement marking; and attaching a unitary retroreflective article to the base pavement marking; wherein the base pavement marking and the unitary retroreflective article define a first portion and a second portion surrounding the first portion on at least two opposing sides; the first portion having a first portion height defined by the distance between a top surface of the unitary retroreflective article and the bottom of the pavement marking, and the second portion having a second portion height above the bottom of the pavement marking that is different than the first portion height.

These and other features and advantages of the invention are more fully shown and described in the drawings and detailed description of this invention. It is to be understood, however, that the drawings and description are for the purposes of illustration only and should not be read in a manner that would unduly limit the scope of this invention.

DESCRIPTION OF ILLUSTRATIVE EMBODIMENTS OF THE INVENTION

Composite pavement markings according to the present invention can be used in a variety of different applications, although they will typically be used to delineate road surfaces, parking lots, etc. The composite pavement markings provide improved wear resistance by providing shorter portions adjacent to taller portions. The taller surrounding portions of the pavement marking offer some protection to the shorter portions from wear caused by vehicle traffic and/or snowplow blades. The composite pavement markings can also provide unique combinations of retroreflective properties by attaching a unitary retroreflective article to a base retroreflective pavement marking.

It may be preferred that the unitary retroreflective articles attached to the pavement marking provide improved wet retroreflectivity to further enhance visibility of the pavement marking under both dry and wet conditions. By locating the unitary retroreflective article within those portions of the pavement marking having a reduced height, the wet reflectivity of the pavement marking may be increased by trapping or pooling water over the unitary retroreflective article.

Figure 1:
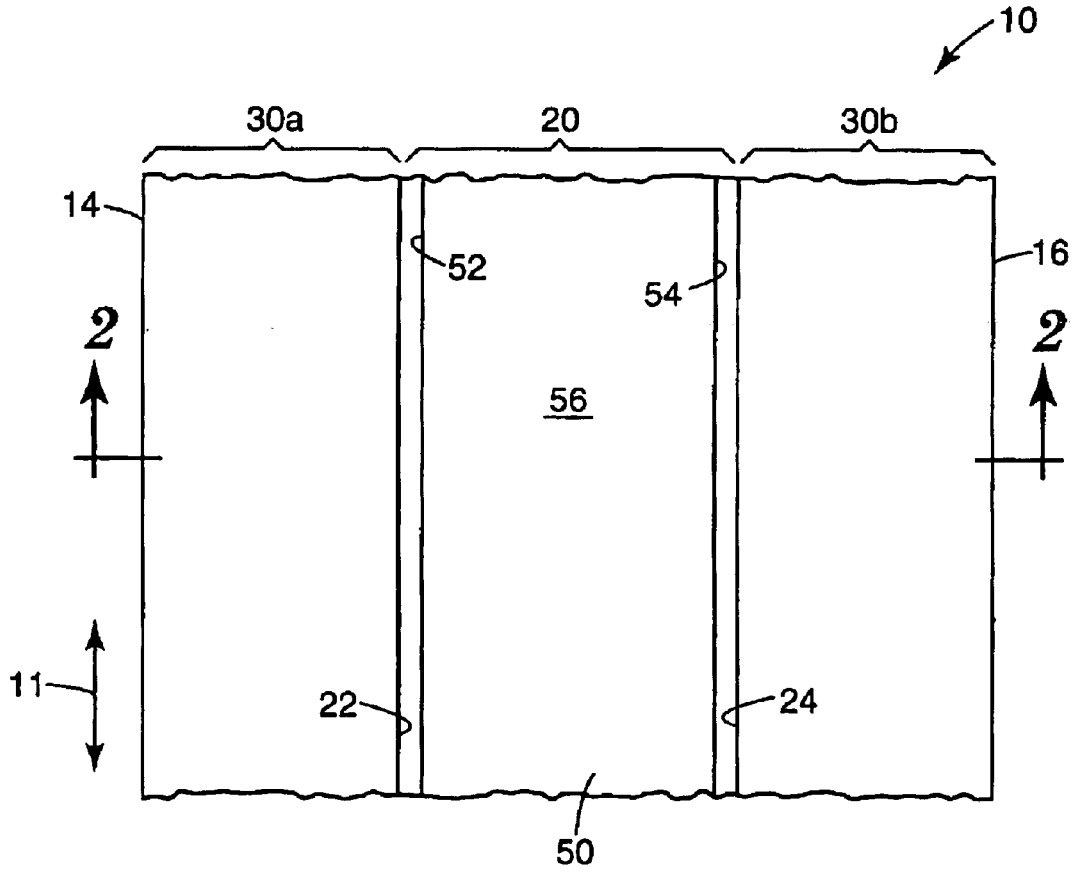
FIG. 1 is a plan view of a portion of one composite pavement marking 10 according to the present invention.
Figure 2:
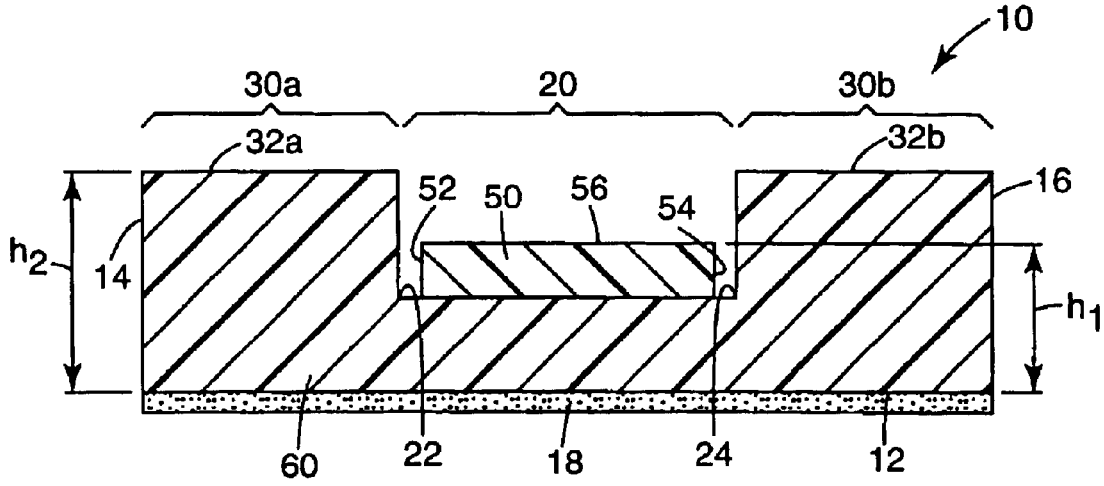
FIG. 2 is a cross-sectional view of the pavement marking 10 taken along line 2—2 in FIG. 1.

One illustrative embodiment of a composite pavement marking according to the present invention is illustrated in FIGS. 1 and 2. The composite pavement marking 10 preferably includes a first portion 20 and a pair of second portions 30*a* and 30*b* (referred to collectively as second portion 30). The second portion 30 preferably surrounds the first portion 20 on its two opposing sides 22 and 24. The composite pavement marking 10 also preferably includes a bottom 12 that optionally, but preferably, includes an adhesive layer 18 that can be used to attach the composite pavement marking 10 to a surface, e.g. a road, parking lot, etc.

FIG. 1 illustrates only a portion of the composite pavement marking 10 which preferably has a marking length extending along the direction of longitudinal axis 11 and a marking width between opposing marking sides 14 and 16, wherein the marking width is measured transverse to the marking length. It may be preferred, but not required, that the marking width be constant along the marking length. Further, it may be preferred, but not required, that the pavement marking sides 14 and 16 be parallel to each other as illustrated in FIG. 1.

In another variation, it may be preferred, but not required that the first portion 20 have a width (also measured transverse to the marking length) that is constant along the marking length. It may be preferred that the first portion 20 include first portion sides 22 and 24 that are straight and parallel to each other as illustrated in FIG. 1.

The first portion 20 of the composite pavement marking 10 depicted in FIGS. 1 and 2 includes a unitary retroreflective article 50 attached to a base pavement marking 60. The unitary retroreflective article 50 includes two sides 52 and 54 and a top surface 56. The first portion height ($h_1$) is defined by the height of the top surface 56 of the article 50 above the bottom 12 of the composite pavement marking 10.

The width of the retroreflective article 50 as measured between its opposing sides 52 and 54 is preferably substantially equal to the first portion width as measured between first portion sides 22 and 24. Generally, however, it may be preferred that the width of article 50 be slightly less than the first portion width to simplify placement of the retroreflective article 50 within the first portion 20. Further, it may be preferred that the unitary retroreflective article 50 extend over the entire length of the composite pavement marking 10

(in the direction of longitudinal axis 11). Alternatively, two or more unitary retroreflective articles 50 may be spaced apart along the length of the composite pavement marking 10 within the first portion 20.

As depicted, the second portions 30*a* and 30*b* are located on opposite sides 52 or 54 of the unitary retroreflective article 50. The second portions 30*a* and 30*b* that have top surfaces 32*a* and 32*b*, respectively, that define a second portion height ($h_2$) above the bottom 12 of the composite pavement marking. Although the heights of each of the second portions 30*a* and 30*b* may preferably be equal as depicted in FIG. 2, the second portions 30*a* and 30*b* may have different second portion heights if so desired.

The first portion height and the second portion heights are, however, not equal in composite pavement markings according to the present invention. Further, the second portion heights may both preferably, but not necessarily, be greater than the first portion height. By providing different portions of the composite pavement marking with different heights, the shorter portions of the composite pavement marking (e.g., the first portion 20 in the depicted marking) may be protected from excessive wear due to traffic and/or snowplowing. As a result, the shorter portion or portions may be better able to maintain their reflectivity for longer periods of time than the taller portions that are subject to more wear.

The unitary retroreflective article 50 may preferably be manufactured as described in detail in U.S. Pat. No. 5,880,885 (Bailey et al.) or International Publication No. WO 97/01677. One advantage of retroreflective articles manufactured according to those disclosures is that they may exhibit improved reflectivity when wet. By locating the article 50 within the trough formed by the second portions 30*a* and 30*b*, the wet reflectivity of such articles may be enhanced because water may pool within the trough. In addition, the retroreflective article 50 may be protected from direct contact with snowplow blades, vehicle tires, etc. to improve its longevity.

Figure 3:
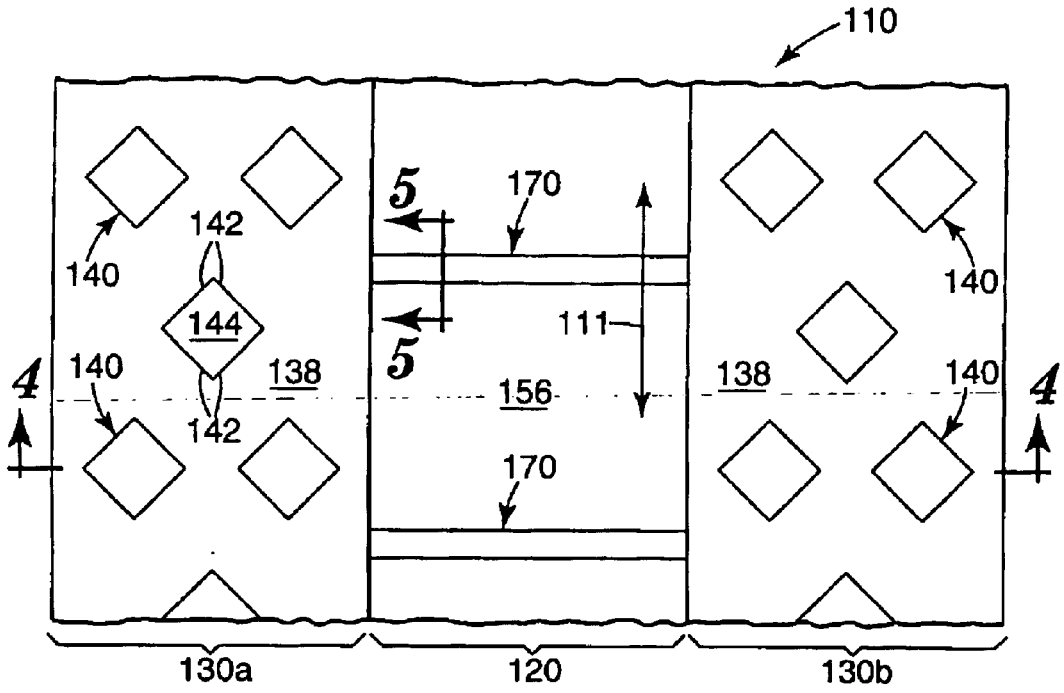
FIG. 3 is a plan view of another composite pavement marking 110 according to the present invention.
Figure 4:
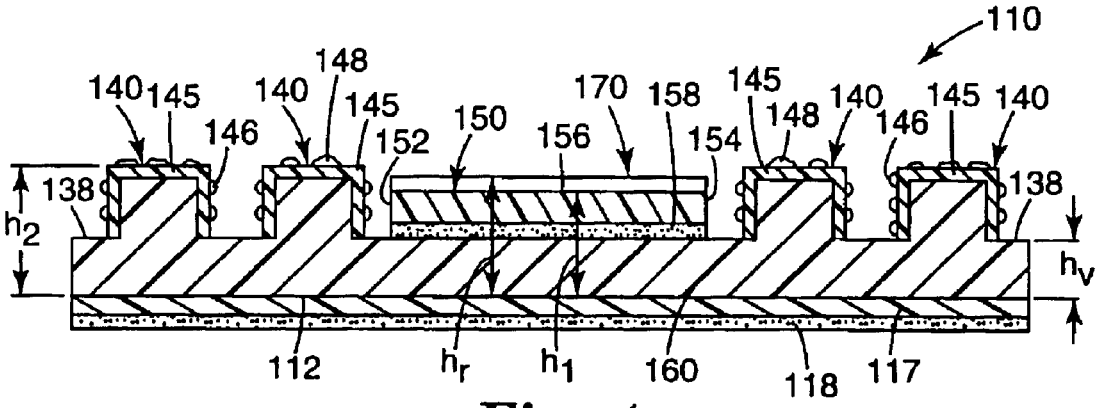
FIG. 4 is a cross-sectional view of the pavement marking 110 taken along line 4—4 in FIG. 3.
Figure 5:
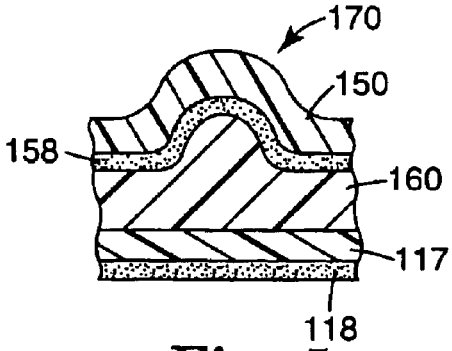
FIG. 5 is a partial cross-sectional view of the pavement marking 110 taken along line 5—5 in FIG. 3.

FIGS. 3–5 depict another illustrative embodiment of a composite pavement marking 110 according to the present invention. The composite pavement marking 110 includes a first portion 120 and opposing second portions 130*a* and 130*b* (collectively referred to as second portion 130) in a manner similar to the composite pavement marking 10 depicted in FIGS. 1 and 2. The second portion 130 surrounds the first portion 120 on at least two opposing sides.

The composite pavement marking 110 depicted in FIGS. 3–5 may preferably be manufactured using a base pavement marking 160 that is coextensive with the width and length of the pavement marking 110. A suitable base pavement marking 160 may be formed using known methods and materials, such as described in, e.g., U.S. Pat. Nos. 4,117,192; 4,388,359; 4,490,432; 4,681,401; 4,969,713; 4,988,555; 4,988,541; 5,087,148; 5,108,218; 5,114,193; 5,139,590; 5,316,406; 5,557,461; 5,643,655; 5,928,761; International Patent Application No. 95 107696.7, filed May 19, 1995; etc.

In addition, the pavement marking 110 may also include optional components such as a conformance layer 117 and an adhesive 118. The optional conformance layer 117 may improve the conformability of the pavement marking 110 to, e.g., a road surface, and the adhesive may be used to adhesively attach the pavement marking 110 to a surface. Suitable adhesives may include, but are not limited to, pressure-sensitive adhesives, rubber resin adhesives, neoprene contact adhesives, etc.

Each of the second portions 130*a* and 130*b* of the depicted base pavement marking 160 includes a plurality of protrusions 140 that are preferably, but not necessarily, formed as an integral part of the base pavement marking 160, i.e., as one single unit and not two or more separate parts subsequently joined together. The protrusions 140 are preferably spaced apart from each other by a valley area 138. The raised nature of the protrusions with respect to the valley area 138 can improve the visibility of the pavement marking 110 in wet conditions as well as provide increased height to protect the unitary retroreflective article 150 located in the first portion 120. In the pavement marking 110 of FIGS. 3–5, the valley area 138 preferably extends across the first portion 120 of the marking 110. The first portion 120 preferably does not include any protrusions 140 as do the second portions 130*a* and 130*b*.

The protrusions 140 may preferably be arranged in a predetermined pattern. An example of one pattern is depicted in FIG. 3, although many other patterns, whether regular, irregular, repeating, non-repeating, etc., could be used in arranging the protrusions 140 on the pavement marking 110. Examples of some additional suitable patterns are described in, e.g., U.S. Pat. No. 5,670,227.

The protrusions 140 illustrated in FIGS. 3–5 may have square outlines defined by four side surfaces 142 that meet at a top surface 144. Although the illustrated protrusions 140 have a square outline, it will be understood that the protrusions 140 could take any desired shape, including, but not limited to: circular, oval, polygonal, etc. For example, it may be desirable to include elongated protrusions in the second portions 130*a* and 130*b* as described in, e.g., International Publication No. WO 99/25928 (Hedblom et al.).

The protrusions 140 also preferably include optical elements 146 captured in, e.g., a binder layer 145 to improve the visibility of the pavement marking 110 as described in many of the patents referenced above. In some embodiments, it may also be desirable to provide optical elements on the top surfaces 144 of the protrusions and/or the valley area 138 between the protrusions 140.

The optical elements 146 may preferably include reflective elements such as beaded retroreflectors, although any structure or material that provides reflection, preferably retroreflection, of incident light is preferred. The types and sizes of, e.g., beaded retroreflective elements will vary depending on a variety of factors that will be well known to those skilled in the art.

The optical elements 146 preferably have a diameter compatible with the size and shape of any protrusions. For the embodiments where the optical elements 146 are embedded in a binder, the optical elements 146 preferably have a diameter compatible with the binder thickness. Generally, optical elements of about 50 to about 1000 micrometers in diameter may be suitably employed.

The optical elements 146 may be provided as an amorphous phase, a crystalline phase, or a combination, as desired. The optical elements 146 may preferably include inorganic materials that are not readily susceptible to abrasion. Suitable optical elements may include microspheres formed of glass, preferably having indices of refraction of from about 1.5 to about 2.3. Commonly used optical elements are made of soda-lime-silicate glasses.

Microcrystalline ceramic optical elements may also be used and are disclosed in U.S. Pat. Nos. 3,709,706; 4,166,147; 4,564,556; 4,758,469; and 4,772,511. Such optical elements typically have higher refractive indexes and enhanced durability. The optical elements may be resistant to scratching and chipping, may be relatively hard (above 700 Knoop hardness), and may exhibit a relatively high index of refraction. The optical elements may include zirconia, alumina, silica, titania, and mixtures thereof. The optical elements can be colored to retroreflect a variety of colors. The optical elements may be colored so that, for example, colorless, yellow, orange, or some other color of light is retroreflected at night.

It may also be desirable to provide skid-resistant particles 148 on the protrusions 140 to improve friction between the pavement marking 110 and, e.g., a vehicle tire. The skid-resistant particles 148 may also be attached using a binder layer and may preferably be located on the top surfaces 144 of the protrusions 140 and/or in the valley area 138 between protrusions 140. The types and sizes of skid-resistant particles 148 that would be useful in connection with the present invention will be well known to those skilled in the art. Illustrative examples of skid-resistant particles include those disclosed in U.S. Pat. Nos. 5,124,178; 5,094,902; 4,937,127; and 5,053,253. Furthermore, the use of multiple binder layers to selectively locate the skid-resistant particles and optical elements is described in, e.g., U.S. Pat. No. 5,676,488.

The protrusions 140 (with optical elements 146) are preferably sized and spaced to provide visible reflectance (preferably retroreflection) of light incident on the pavement marking 110. As a result, the protrusions 140 preferably have a relatively short length (as measured along the longitudinal axis 111). The short length of the protrusions 140 can tend to increase the total surface area of the protrusions 140 carrying optical elements 146 visible to, e.g., drivers of vehicles viewing the pavement marking 110 from relatively great distances.

The composite pavement marking 110 also includes a unitary retroreflective article 150 attached to the valley area 138 within the first portion 120. The unitary retroreflective article 150 retroreflects light incident thereon to improve visibility of the marking 110. The unitary retroreflective article 150 includes two sides 152 and 154 and a top surface 156.

Also depicted in FIGS. 3–5 are ridges 170 located within the first portion 120. The ridges 170 may improve the retroreflectivity of the marking 110 within the first portion by, e.g., presenting a portion of the unitary retroreflective article 150 to a driver or other observer in a vertical orientation. The ridges 170 have a ridge height ($h_r$) above the bottom surface 112 of the pavement marking 110. That ridge height may preferably be a combination of both the height of the ridge (if any) as formed in the base pavement marking 160 and the unitary retroreflective article 150.

If formed at least partially in the base pavement marking 160, the ridges 170 may be formed by, e.g., the same technique used to form the protrusions 140 (see, e.g., U.S. Pat. No. 4,988,555) or by any other suitable technique, e.g., providing an additional amount of a binder material that may be used to secure the optical elements 146 and/or skid-resistant particles 148. Alternatively, the area of the base pavement marking 160 that lies within the first portion 120 of the composite pavement marking 110 may be flat, with the ridges formed in the unitary retroreflective article 150 attached to the base pavement marking 160.

The width of the retroreflective article 150 as measured between its opposing sides 152 and 154 is preferably substantially equal to the first portion width as measured between the opposing second portions 130*a* and 130*b*. Generally, however, it may be preferred that the width of article 150 be slightly less than the first portion width to simplify placement of the retroreflective article 150 within the first portion 120.

The second portions 130*a* and 130*b* of the pavement marking 110 have a height ($h_2$) that is measured from the top of the protrusions 140 to the bottom 112 of the pavement marking 110. The second portion heights of each second portion 130*a* and 130*b* are preferably, but not necessarily equal. Where the valley area 138 extends across the pavement marking 110 through the first portion 120, the valley height ($h_v$), as measured between the bottom 112 of the pavement marking 110 and the valley area 138, may preferably be constant across the entire width of the pavement marking 110. In other words, the valley height is the same in the second portions 130*a* and 130*b* as it is within the first portion 120. Alternatively, the height of the base pavement marking 160 within the first portion 120 may differ from the height of the valley area 138 within the second portions 130*a* and 130*b*.

The first portion height ($h_1$) is defined by the height of the top surface 156 of the article 150 above the bottom 112 of the marking 110 between the ridges 170 or any other raised features. It may be preferred that the first portion height and the second portion heights are, however, not equal in the pavement markings according to the present invention. Further, the second portion heights may both preferably, but not necessarily, be greater than the first portion height. By providing different portions of the composite pavement marking 110 with different heights, the shorter portions of the pavement marking 110 (the first portion 120 in the depicted marking) may be protected from excessive wear due to traffic and/or snowplowing. As a result, the shorter portion or portions may be better able to maintain their reflectivity for longer periods of time than the taller portions that are subject to more wear.

In addition to the relative height relationships described above, it may be desirable to provide ridges 170 with a ridge height $h_r$ that is equivalent to the second portion height $h_2$. By providing a ridge height similar to the height of the second portion 130, the composite pavement marking 110 may be more easily wound into rolls during manufacturing, maintain that roll form during transportation and storage, and maintain that roll form during application onto a road surface. For example, the rolls of composite pavement marking thus formed may be more resistant to telescoping and other problems associated with rolls of material.

To improve the efficacy of the ridges 170 in maintaining roll form for the pavement marking 110, it may be preferred that the ridges 170 extend across the width of the first portion 120. Furthermore, although the ridges 170 depicted in FIGS. 3–5 are provided in the form of straight lines across the first portion 120 of the pavement marking 110, the ridges may be provided in other configurations as well, e.g., curved lines, a combination of line segments, a grid pattern, etc.

One method of manufacturing the composite pavement marking 110 may include manufacturing the base pavement marking 160 including the protrusions 140 and any optical elements 146 and/or skid-resistant particles 148 according to methods described in e.g., U.S. Pat. Nos. 4,988,555; 4,988,541; 5,227,221; 5,777,791, etc. The first portion 120 of the base pavement marking 160 may preferably, however, be free of protrusions 140 to improve adhesion of the retroreflective article 150 to the base pavement marking 160. The first portion 120 may, however, include ridges 170 as described above. Conformability of the unitary retroreflective article 150 over the ridges 170 may be improved when the ridges 170 have a uniform shape across the width of the first portion 120.

As with the composite pavement marking 10 described above, the unitary retroreflective article 150 may preferably be manufactured according to the methods described in U.S. Pat. No. 5,880,885 (Bailey et al.) or International Publication No. WO 97/01677 to provide improved wet retroreflective properties to the composite pavement marking 110. In addition, when the retroreflective article 150 is located within the lower portions of the composite pavement marking 110, it may be protected from excessive wear due to snowplow blades, vehicle tires, etc., for at least a portion of its life.

The unitary retroreflective article 150 may be attached to the base pavement marking 160 by any suitable technique. One example is that adhesive 158 located between the retroreflective article 150 and the base pavement marking 160 may be used to attach the article 150. Alternative techniques of attaching the retroreflective article 150 may include, e.g., thermoplastic materials, thermoset materials, pressure sensitive adhesive, curable adhesive, etc. In some instances, it may be preferred that the unitary retroreflective article 150 be attached to the base pavement marking 160 in-line, such that the unitary retroreflective article 150 is attached to the base pavement marking 160 while the base pavement marking 160 is being manufactured. In a further alternative, it may be preferred that both the unitary retroreflective article 150 and the base pavement marking 160 be manufactured in-line while both articles are being manufactured.

In addition to the advantages regarding reduced wear and/or wet reflectivity, the use of a separate retroreflective article in connection with the pavement markings also provides an opportunity to provide composite pavement markings with improved contrast. For example, the unitary retroreflective article 150 of composite pavement marking 110 could be provided in a daytime color that is different than the daytime color of the second portions 130*a* and 130*b*. One potential combination is that the article 150 could be provided in a color or colors that contrast with the surrounding second portions 130*a* and 130*b* which maybe provided in black. As used here, "black" is defined as having a low luminance factor and being substantially achromatic, or as preferably having a Y value of about 20 or less, preferably about 15 or less, and more preferably about 10 or less. Colors that contrast with black may include, but are not limited to, white, gray, silver yellow, orange, etc. Contrasting colors may be fluorescent if desired.

Figure 6:
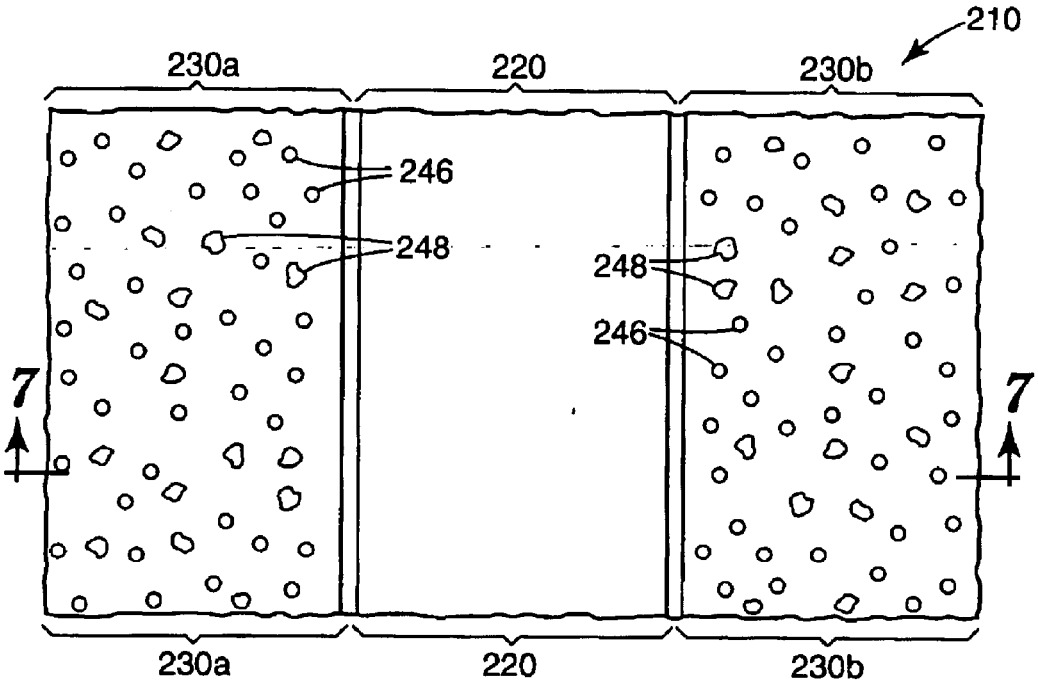
FIG. 6 is a plan view of another composite pavement marking 210 according to the present invention.
Figure 7:
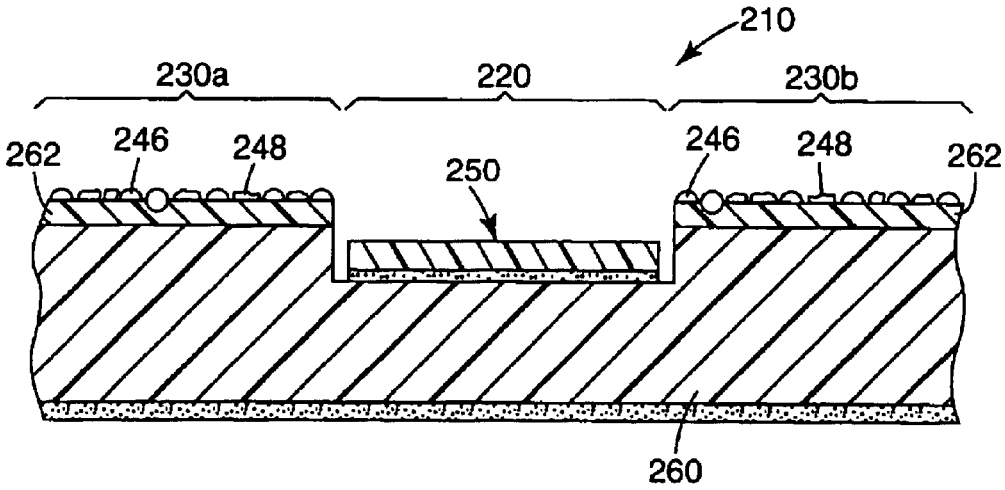
FIG. 7 is a cross-sectional view of the pavement marking 210 taken along line 7—7 in FIG. 6.

Another composite pavement marking 210 according to the present invention is illustrated in FIGS. 6 and 7. The composite pavement marking 210 includes a base pavement marking 260 that extends continuously across the width of the pavement marking 210. The illustrated base pavement marking 260 is taller along both second portions 230*a* and 230*b* (collectively referred to as second portion 230) than along the first portion 220 to provide protection to the first portion 220 from, e.g., vehicle tires, etc.

The second portion 230 may include optical elements 246 and/or skid-resistant particles 248 protruding from a topcoat layer 262 provided on the base pavement marking 260. The first portion 220 may include a retroreflective article 250 attached to the topcoat layer 262 (or, optionally, directly to the base pavement marking 260).

For environments in which pavement is initially black when installed and is progressively bleached with exposure to sunlight (e.g., as with asphalt used in Florida), the composite pavement marking 210 may provide advantages in visibility by changing color during wear. For example, the first portion 220 may exhibit a light daytime color (e.g., silver or gray) while the surrounding topcoat layer 262 is also light colored (e.g., white). As a result, the pavement marking as applied would appear uniformly lightly colored in contrast with surrounding black of the new asphalt pavement.

In such a construction, the base pavement marking 260 may preferably be black in color to provide contrast over the life of the product. That contrast is provided by removal of the light topcoat layer 262 (due to traffic, etc.) while the black pavement is bleached by exposure to the elements. In other words, as the pavement becomes progressively lighter in color, the second portion 230 becomes progressively darker as the black base pavement marking 260 is exposed. The darkening second portion 230 visually contrasts with the bleaching pavement surrounding the marking 210. In addition, the darkening second portion 230 also visually contrasts with the lighter colored first portion 220 that is surrounded on at least two opposing sides by the second portion 230 (which preferably does not wear as quickly due to the protection provided by the surrounding taller second portion 230). Eventually, however, even the first portion 220 may also wear down, causing the entire pavement marking 210 (including the first portion 220) to appear black relative to the surrounding bleached pavement, thus providing a visual guide for replacement of the pavement markings. Even in those instances, however, where the first portion 220 does not change in color, the black second portion 230 can provide a replacement guide.

Figure 8:
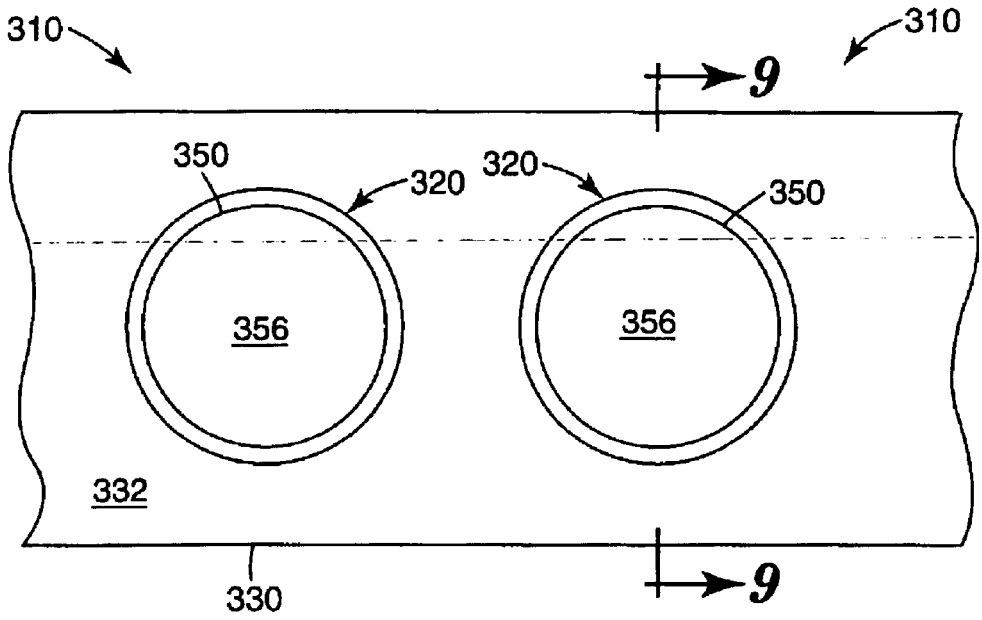
FIG. 8 is a plan view of another composite pavement marking 310 according to the present invention.
Figure 9:
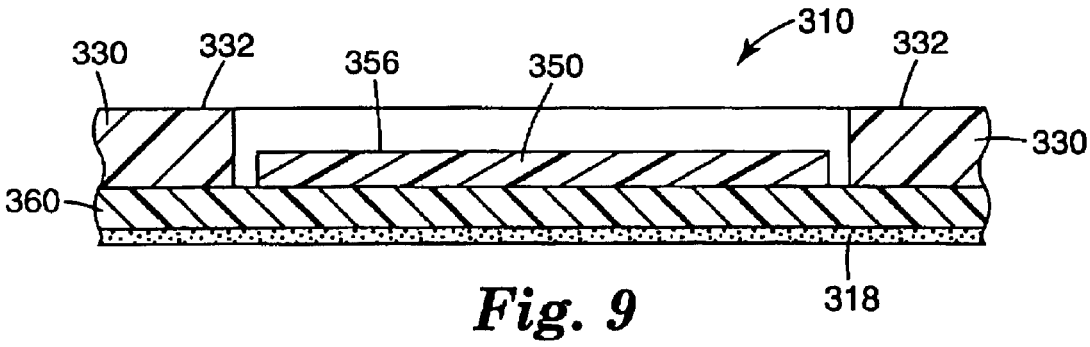
FIG. 9 is a cross-sectional view of the pavement marking 310 taken along line 9—9 in FIG. 8.

FIGS. 8 and 9 depict yet another embodiment of a composite pavement marking 310 according to the present invention. The composite pavement marking 310 includes a plurality of discrete first portions 320 located at intervals along the length of the composite pavement marking 310 (it being understood that a plurality may include two or more of the first portions).

Each of the first portions 320 is preferably surrounded on all sides by the second portion 330. As a result, the first portion 320 is located within a void or depression formed in the second portion 330. The second portion 330 may be continuous (as shown) or it may be formed of a composite of multiple pieces fitted around the plurality of first portions 320.

It may be preferred that any void defining the first portion 320 in the second portion 330 be formed completely through the second portion 330 to expose an underlying base sheet 360. A discrete unitary retroreflective article 350 may then be provided within each of the first portions 320 of the composite pavement marking 310. Preferably, the retroreflective article 350 is attached to the exposed area of the base sheet 360 by any suitable technique (e.g., adhesively, welding, etc.).

The base sheet 360 is preferably coextensive with the pavement marking 310, i.e., the base sheet 360 preferably extends for the full width and full length of the pavement marking 310. An adhesive layer 318 may also optionally be provided.

It is preferred that the height of the first portion 320 (as determined by the height of the top surface 356 of the retroreflective article 350) be set below the height of the top surface 332 of the second portion 330 (see, e.g., FIG. 9). Such an arrangement provides protection for the retroreflective article 350 from, e.g., vehicle traffic, snowplow blades, etc. The arrangement may also allow water to collect on the retroreflective article 350 which, if it provides wet retroreflectivity as do the articles described in U.S. Pat. No. 5,880,885, may improve wet retroreflectivity for the pavement marking 310 as a whole.

The patents, patent documents, and publications cited herein are incorporated by reference in their entirety, as if each were individually incorporated by reference. Various modifications and alterations of this invention will become apparent to those skilled in the art without departing from the scope of this invention. Accordingly, it is to be understood that this invention is not to be limited to the illustrative embodiments set forth herein, but is to be controlled by the limitations set forth in the following claims and any equivalents thereof.

What is claimed is:

1. A composite pavement marking having a marking length and a marking width transverse to the marking length, the marking width defined by marking sides extending along the marking length, wherein the pavement marking further includes a bottom extending along the marking length and marking width, the pavement marking comprising:

a first portion comprising a first portion width between first portion sides that is less than the marking width;

a unitary retroreflective article attached to the first portion of the pavement marking, wherein a first portion height is defined by the distance between a top surface of the unitary retroreflective article and the bottom of the pavement marking, and wherein the unitary retroreflective article has a width that is substantially equal to the first portion width; and a second portion surrounding the first portion on at least two opposing sides, wherein the second portion comprises a second portion height above the bottom of the pavement marking that is different than the first portion height.

2. The composite pavement marking of claim 1, wherein the second portion height is greater than the first portion height.

3. The composite pavement marking of claim 1, wherein the unitary retroreflective article and the first portion extend along substantially all of the marking length.

4. The composite pavement marking of claim 1, wherein the first portion comprises a plurality of ridges having a ridge height above the bottom of the pavement marking.

5. The composite pavement marking of claim 4, wherein the ridges extend across the first portion width.

6. The composite pavement marking of claim 4, wherein the ridge height is equivalent to the second portion height.

7. The composite pavement marking of claim 1, further comprising a base pavement marking, wherein the second portions of the composite pavement marking are formed in the base pavement marking.

8. The composite pavement marking of claim 7, wherein the unitary retroreflective article is attached to the base pavement marking.

9. The composite pavement marking of claim 1, wherein the unitary retroreflective article is adhesively attached to the first portion of the pavement marking.

10. The composite pavement marking of claim 1, wherein the second portion comprises a plurality of retroreflective elements.

11. The composite pavement marking of claim 10, wherein at least some of the plurality of retroreflective elements are attached to a plurality of protrusions extending above and separated by a valley area within the second portion, wherein the height of the plurality of protrusions above the bottom of the pavement marking defines the second portion height.

12. The composite pavement marking of claim 11, wherein the valley area in the second portion defines a valley height above the bottom of the pavement marking, and further wherein the valley height of the second portion is about equal to or less than the first portion height.

13. The composite pavement marking of claim 1, wherein the unitary retroreflective article exhibits a first color and the second portion of the pavement marking exhibits a second color that contrasts with the first color.

14. The composite pavement marking of claim 1, wherein the unitary retroreflective article and the second portion of the pavement marking exhibit a uniformly lightly colored appearance.

15. A composite pavement marking having a marking length and a marking width transverse to the marking length, the marking width defined by marking sides extending along the marking length, wherein the pavement marking further includes a bottom extending along the marking length and marking width, the pavement marking comprising:

a first portion comprising a first portion width between first portion sides that is less than the marking width;

a unitary retroreflective article attached to the first portion of the pavement marking, wherein a first portion height is defined by the distance between a top surface of the unitary retroreflective article and the bottom of the pavement marking; and a second portion surrounding the first portion on at least two opposing sides, wherein the second portion comprises a second portion height above the bottom of the pavement marking that is different than the first portion height, and further comprising a plurality of discrete first portions surrounded by a second portion, each of the plurality of first portions comprising a discrete unitary retroreflective article attached thereto.

16. The composite pavement marking of claim 15, further comprising a base sheet substantially coextensive with the marking length and the marking width, wherein the unitary retroreflective article within each of the plurality of first portions and the second portions are attached to the base sheet.

17. The composite pavement marking of claim 15, wherein each of the first portions are defined by voids formed through the second portion.

18. The composite pavement marking of claim 15, wherein the second portion height is greater than the first portion height.

19. The composite pavement marking of claim 15, wherein the second portion comprises a plurality of retroreflective elements.

20. The composite pavement marking of claim 19, wherein at least some of the plurality of retroreflective elements are attached to a plurality of protrusions extending above and separated by a valley area within the second portion, wherein the height of the plurality of protrusions above the bottom of the pavement marking defines the second portion height.

21. The composite pavement marking of claim 15, wherein the unitary retroreflective articles exhibit a first color and the second portion of the pavement marking exhibits a second color that contrasts with the first color.

22. The composite pavement marking of claim 15, wherein the unitary retroreflective articles and the second portion of the pavement marking exhibit a uniformly lightly colored appearance.

23. A composite pavement marking having a marking length and a marking width transverse to the marking length, the marking width defined by marking sides extending along the marking length, wherein the pavement marking further includes a bottom extending along the marking length and marking width, the pavement marking comprising:

a first portion comprising a first portion width between first portion sides that is less than the marking width, the first portion extending along substantially all of the marking length;

a unitary retroreflective article attached to the first portion of the pavement marking, wherein a first portion height is defined by the distance between a top surface of the unitary retroreflective article and the bottom of the pavement marking, and further wherein the unitary retroreflective article extends along substantially all of the marking length; and a second portion surrounding the first portion on two opposing sides, wherein the second portion comprises a second portion height above the bottom of the pavement marking that is greater than the first portion height.

24. The composite pavement marking of claim 23, wherein the unitary retroreflective article is adhesively attached to the first portion of the pavement marking.

* * * * *